US007324050B2

(12) United States Patent
Chung et al.

(10) Patent No.: US 7,324,050 B2
(45) Date of Patent: Jan. 29, 2008

(54) ANTENNA

(75) Inventors: Tsung-Ying Chung, Taipei (TW); Hsi-Tseng Chou, Taipei (TW); Chih-Ming Wang, Taipei (TW)

(73) Assignee: Wistron NeWeb Corp., Taipei Hsien (TW)

( * ) Notice: Subject to any disclaimer, the term of this patent is extended or adjusted under 35 U.S.C. 154(b) by 156 days.

(21) Appl. No.: 11/251,459

(22) Filed: Oct. 13, 2005

(65) Prior Publication Data

US 2007/0008224 A1 Jan. 11, 2007

(30) Foreign Application Priority Data

Jul. 11, 2005 (TW) ..... 94123342 A

(51) Int. Cl.
*H01Q 1/38* (2006.01)

(52) U.S. Cl. ..... 343/700 MS

(58) Field of Classification Search ..... 343/700 MS, 343/702, 767, 895

See application file for complete search history.

(56) References Cited

U.S. PATENT DOCUMENTS

| | | | | |
|---|---|---|---|---|
| 5,410,749 | A * | 4/1995 | Siwiak et al. | 455/280 |
| 6,040,803 | A * | 3/2000 | Spall | 343/700 MS |
| 7,215,286 | B2 * | 5/2007 | Chen | 343/700 MS |
| 2006/0038721 | A1 * | 2/2006 | Ozkar et al. | 343/700 MS |
| 2006/0061513 | A1 * | 3/2006 | Sato | 343/767 |
| 2006/0082503 | A1 * | 4/2006 | Gaucher et al. | 343/700 MS |

* cited by examiner

*Primary Examiner*—Huedung Mancuso
(74) *Attorney, Agent, or Firm*—Quintero Law Office

(57) ABSTRACT

An antenna comprises a signal line, a conductive element, a receiving element, a ground element, a short element and a bandwidth modifying element. The conductive element is coupled to the signal line. The receiving element is connected to the conductive element. The short element is coupled to the ground element and the conductive element. The bandwidth modifying element is connected to the conductive element and located between the receiving element and the ground element. The antenna receives a plurality of wireless signals comprising a center signal with a center frequency, and the center signal comprises a center wavelength λ.

27 Claims, 6 Drawing Sheets

ANTENNA

BACKGROUND

The invention relates to an antenna, and more particularly to a wideband antenna receiving wireless video signals.

FIG. 1*a* shows a conventional inverted F-shaped flat antenna 10, which comprises a ground element 1, a conductive element 2, a receiving element 3, a short element 4 and a signal line 5. The receiving element 3 is connected to an end of the conductive element 2 and is perpendicular thereto. The signal line 5 is connected to another end of the conductive element 2. The ground element 1 is grounded. The short element 4 is connected to the receiving element 3 and the ground element 1 to minimize the antenna 10.

FIG. 1*b* shows signal reception of the antenna 10. When a center frequency of the signals received by the antenna 10 is 425 MHz, the bandwidth (bandwidth defined as signals having gain lower than −10 dB) thereof is less than 25 MHz.

Improvement in digital television technology has lead to a demand for receiving television signals in different frequencies to provide different television channels by flat antenna. The frequencies of wireless digital television signals are between 400-800 MHz, and an antenna for receiving wireless digital television signals must have a bandwidth of at least 200 MHz. Thus, a conventional flat antenna cannot be utilized for receiving wireless digital television signals.

SUMMARY

An embodiment of an antenna comprises a signal line, a conductive element, a receiving element, a ground element, a short element and a bandwidth modifying element. The conductive element is coupled to the signal line. The receiving element is connected to the conductive element. The short element is coupled to the ground element and the conductive element. The bandwidth modifying element is connected to the conductive element and located between the receiving element and the ground element. The antenna receives a plurality of wireless signals comprising a center signal with a center frequency, the center signal comprising a center wavelength λ.

The invention can receive television signals in different frequencies to provide different television channels.

BRIEF DESCRIPTION OF THE DRAWINGS

The invention will be more fully understood from the following detailed description and the accompanying drawings, given by the way of illustration only and thus not intended to limit the disclosure.

DETAILED DESCRIPTION

The embodiments of the inventions are disclosed in the following description, wherein the first and the second embodiments disclose main structure of the invention, and the third and the fourth embodiments are modified embodiments. The design principle and improvement are disclosed in the third embodiment.

First Embodiment

Figure 1A:
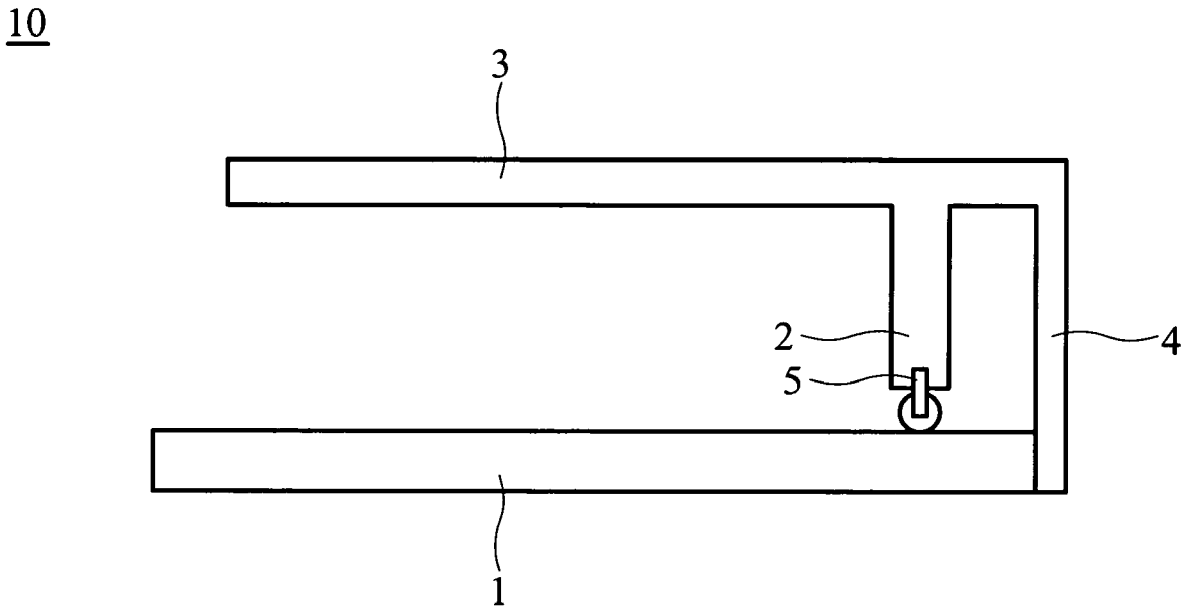
FIG. 1a (RELATED ART)
FIG. 1*a* shows a conventional flat antenna.
Figure 1B:
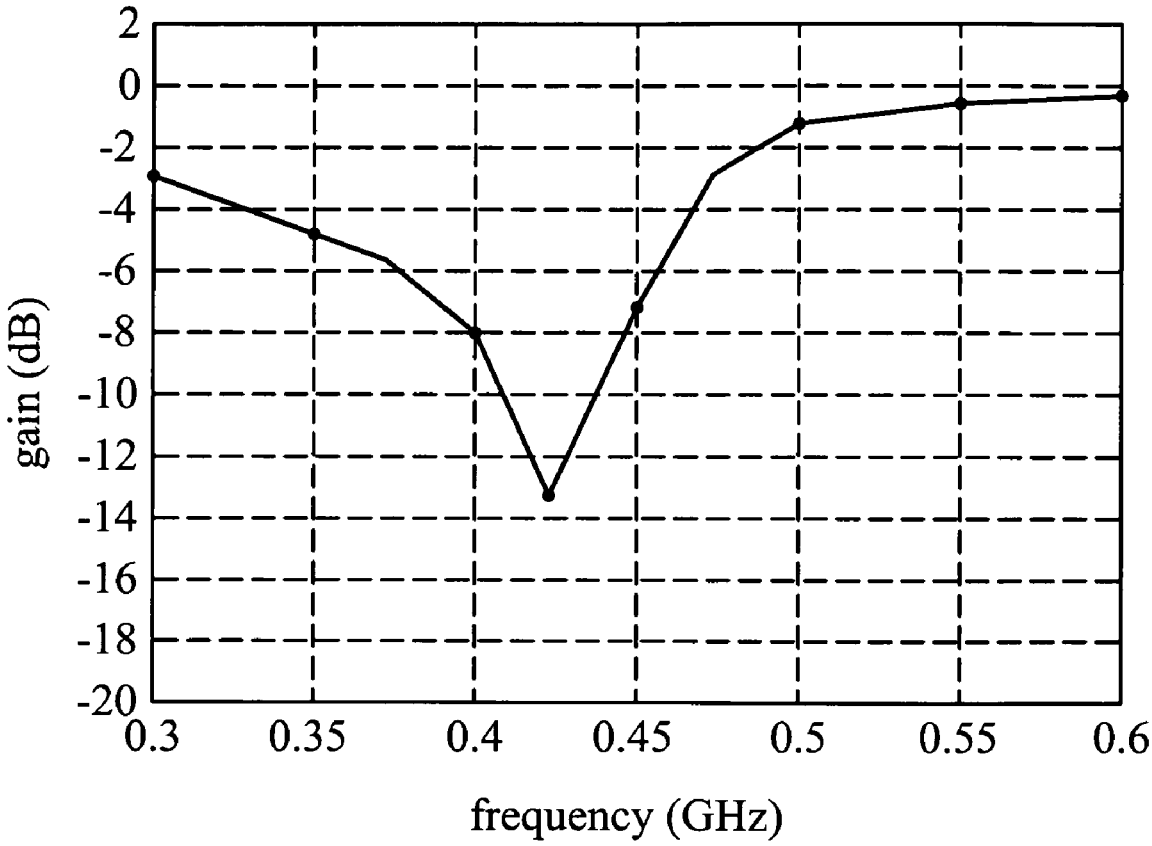
FIG. 1b (RELATED ART)
FIG. 1*b* shows signal reception of the conventional flat antenna.
Figure 2:
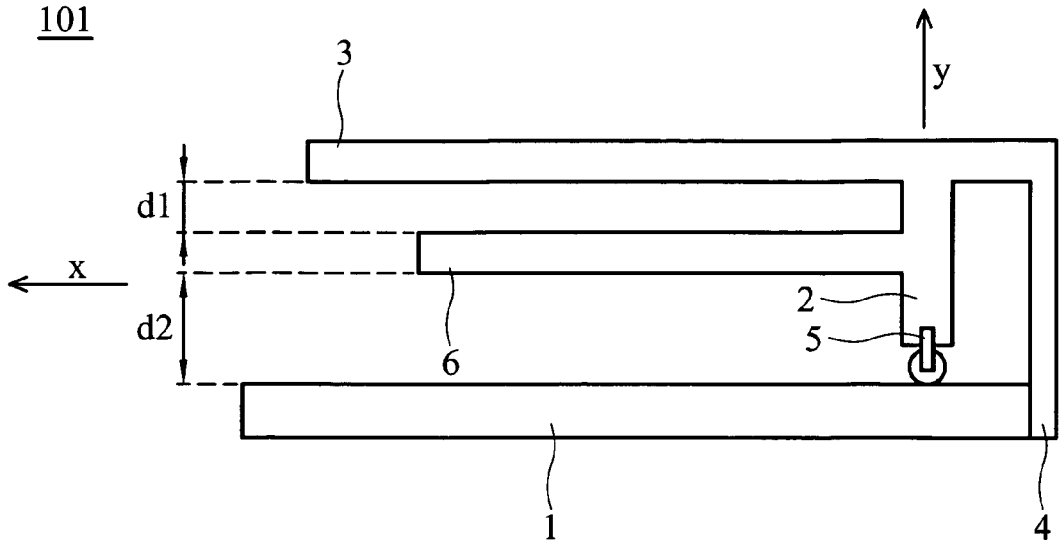
FIG. 2 shows an antenna of a first embodiment of the invention.

FIG. 2 shows an antenna 101 of a first embodiment of the invention, which comprises a ground element 1, a conductive element 2, a receiving element 3, a short element 4, a signal line 5 and a bandwidth modifying element 6. The receiving element 3 is connected to an end of the conductive element 2 and extends in a first direction x. The bandwidth modifying element 6 is connected to the conductive element 2 and extends in the first direction x. The conductive element 2 is connected to the signal line 5 and extends in a second direction y. The second direction y is perpendicular to the first direction x. The ground element 1 is grounded. The short element 4 is connected to the receiving element 3 and the ground element 1 to minimize the antenna 101. The conductive element 2, the receiving element 3, the short element 4 and the bandwidth modifying element 6 are metal sheets.

Antenna 101 receives a plurality of wireless signals. The wireless signals comprise a center signal with a center frequency, and the center signal comprises a center wavelength λ. For example, in this embodiment, the frequencies of the wireless signals are between 500 MHz and 650 MHz, and the center frequency is 575 MHz.

The ground element 1, the receiving element 3 and the bandwidth modifying element 6 are parallel. A first gap d1 is formed between the receiving element 3 and the bandwidth modifying element 6. The first gap d1 is between 0.01λ and 0.025λ, preferably 0.018λ. A second gap d2 is formed between the ground element 1 and the bandwidth modifying element 6. The second gap d2 is between 0.01λ and 0.025λ, preferably 0.018λ.

Second Embodiment

Figure 3:
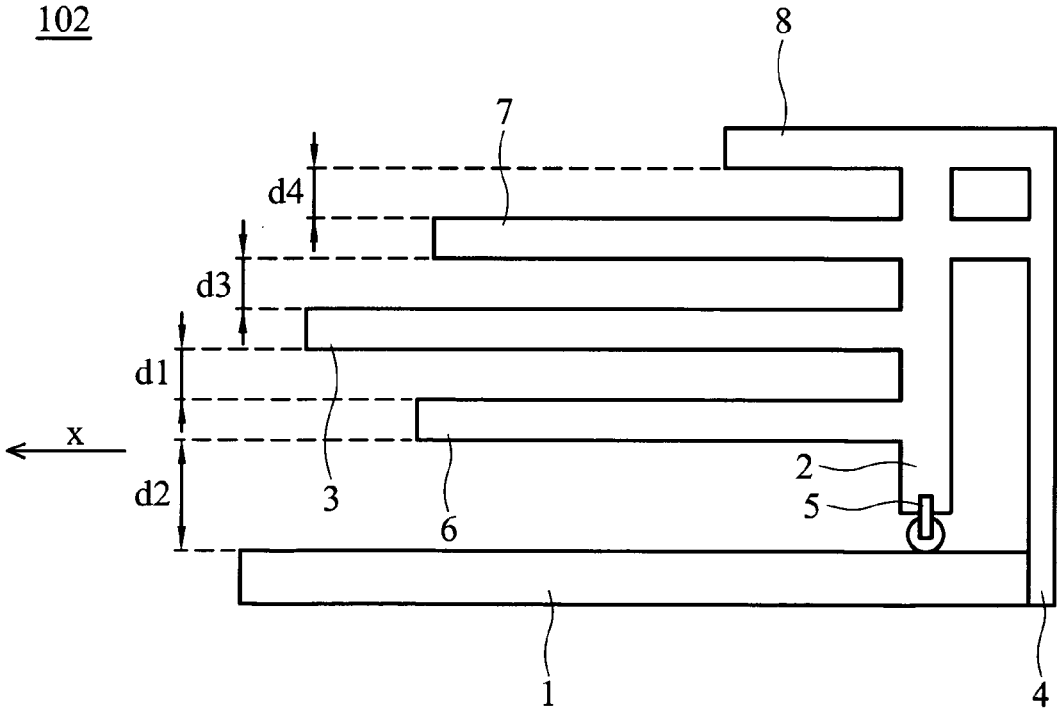
FIG. 3 shows an antenna of a second embodiment of the invention.

FIG. 3 shows an antenna 102 of a second embodiment of the invention. The antenna 102 differs from the first embodiment by further comprising a first matching element 7 and a second matching element 8. The first matching element 7 and the second matching element 8 are metal sheets, connected to the conductive element 2, extending in the first direction x and parallel to the receiving element 3. The short element 4 is connected to the conductive element 2 at a location corresponding to the first matching element 7 and the second matching element 8 to minimize the antenna 102.

A gap d3 is formed between the first matching element 7 and the receiving element 3. A gap d4 is formed between the second matching element 8 and the first matching element 7. By modifying gaps d3, d4 and the length of the first matching element 7 and the second matching element 8, noise of the antenna 102 is eliminated, and signal reception thereof improved.

Third Embodiment

Figure 4A:
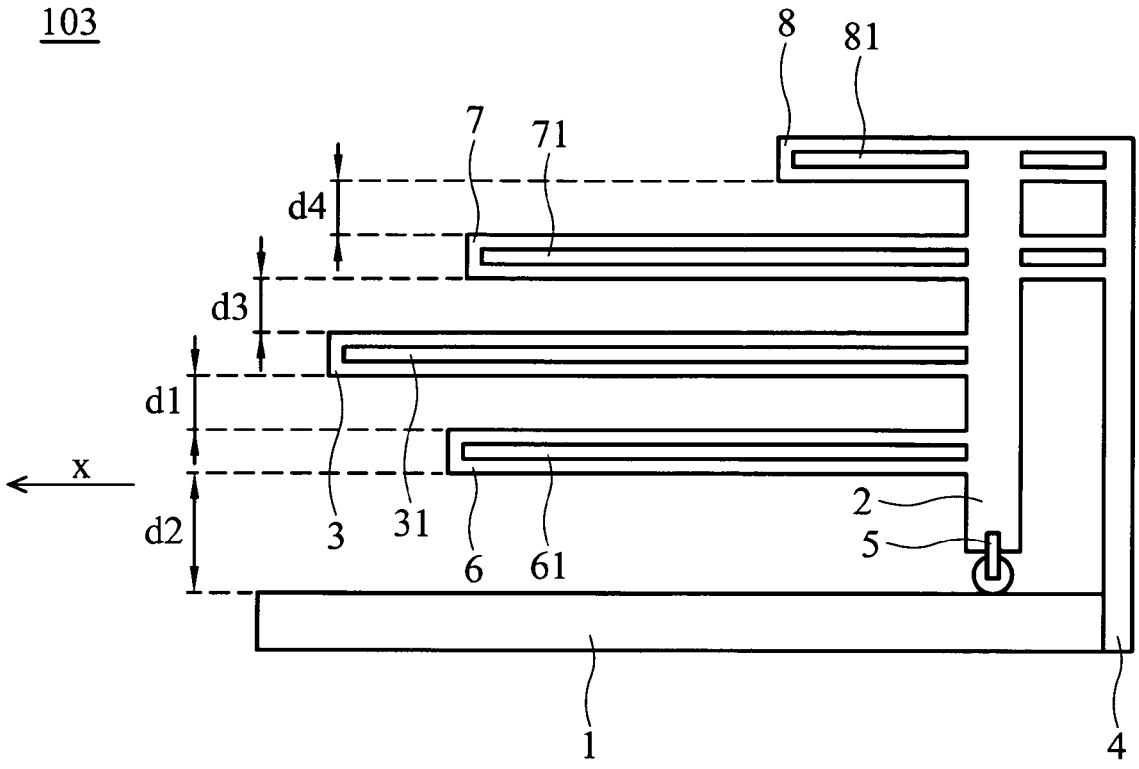
FIG. 4*a* shows an antenna of a third embodiment of the invention.

FIG. 4*a* shows an antenna 103 of a third embodiment of the invention, which differs from the second embodiment by a first opening 31, a third opening 61, a fifth opening 71 and a seventh opening 81 to minimize the antenna 103. The first opening 31 is formed on a surface of the receiving element 3 and extends to another surface opposite thereto. The third opening 61 is formed on a surface of the bandwidth modifying element 6 and extends to another surface opposite thereto. The fifth opening 71 is formed on a surface of the first matching element 7 and extends to another surface opposite thereto. The seventh opening 81 is formed on a surface of the second matching element 8 and extends to another surface opposite thereto. The first opening 31, the third opening 61, the fifth opening 71 and the seventh opening 81 are longitudinal.

Figure 4B:
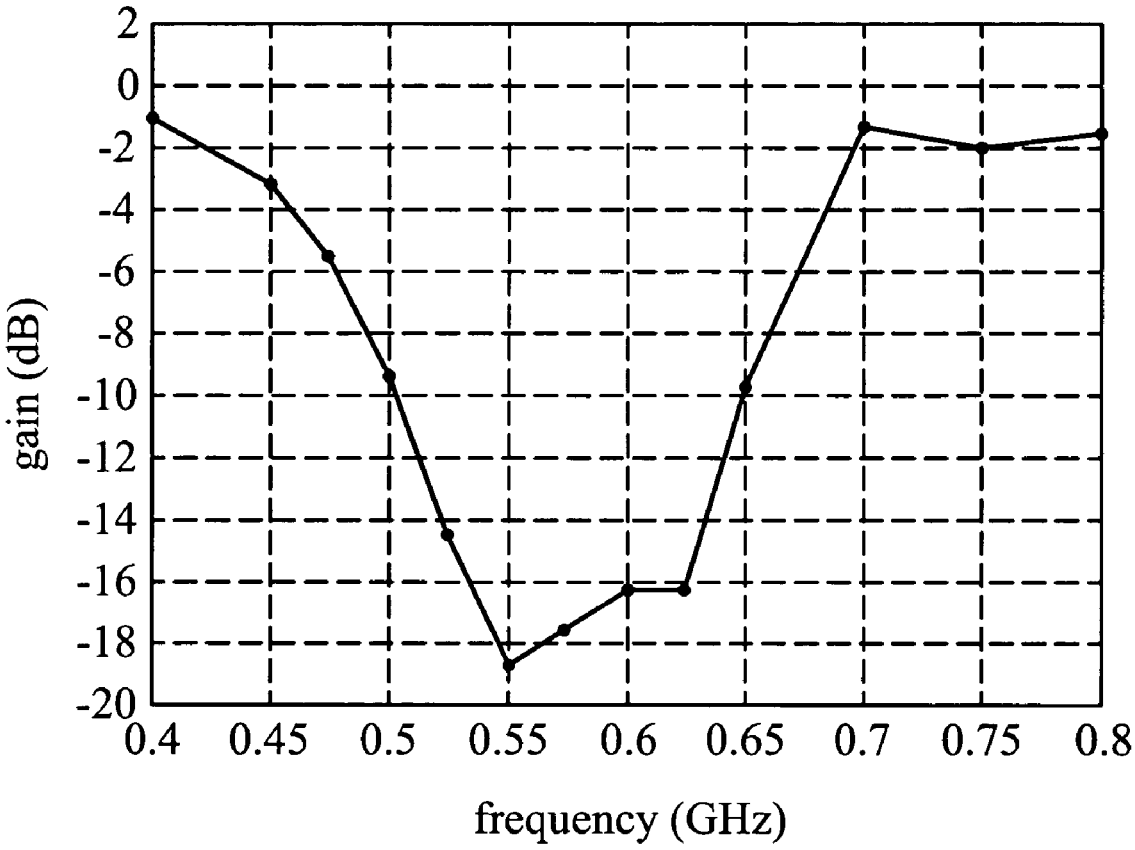
FIG. 4*b* shows signal reception of the third embodiment.

FIG. 4*b* shows signal reception of the antenna 103. When a center frequency of the signals received by the antenna 103 is 575 MHz, the bandwidth (bandwidth defined as signals having gain lower than −10 dB) thereof is 150 MHz (between 500 MHz and 650 MHz). The invention thus provides wider bandwidth and improved signal reception.

The invention couples the resonances of the receiving element 3 and the bandwidth modifying element 6 for increased bandwidth. More particularly, the invention couples resonances near two approximated major resonances (the resonances of the receiving element 3 and the bandwidth modifying element 6) for increased bandwidth.

The invention receives television signals in different frequencies to provide different television channels.

Fourth Embodiment

Figure 5A:
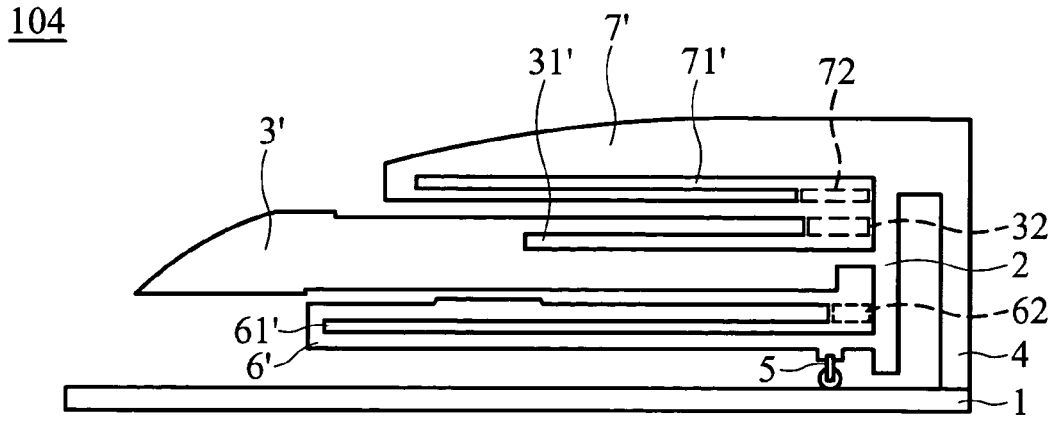
FIG. 5*a* is a side view of an antenna of the fourth embodiment of the invention.

FIG. 5*a* shows an antenna 104 of a fourth embodiment of the invention, which comprises a receiving element 3', a bandwidth modifying element 6', a matching element 7', a ground element 1, a signal line 5, a conductive element 2 and a short element 4. A first opening 31' is formed on a surface of the receiving element 3' and extends to another surface opposite thereto. A third opening 61' is formed on a surface of the bandwidth modifying element 6' and extends to another surface opposite thereto. A fifth opening 71' is formed on a surface of the matching element 7' and extends to another surface opposite thereto.

The edges and the ends of the receiving element 3' and the matching element 7' can be curved. A second opening 32 is formed on an edge of the receiving element 3' and extends to another edge opposite thereto. A fourth opening 62 is formed on an edge of the bandwidth modifying element 6' and extends to another edge opposite thereto. A sixth opening 72 is formed on an edge of the matching element 7' and extends to another edge opposite thereto. The second opening 32 is connected to the first opening 31'. The fourth opening 62 is connected to the third opening 61'. The sixth opening 72 is connected to the fifth opening 71'. The second opening 32, the fourth opening 62 and the sixth opening 72 are longitudinal and further minimize the antenna 104.

Figure 5B:
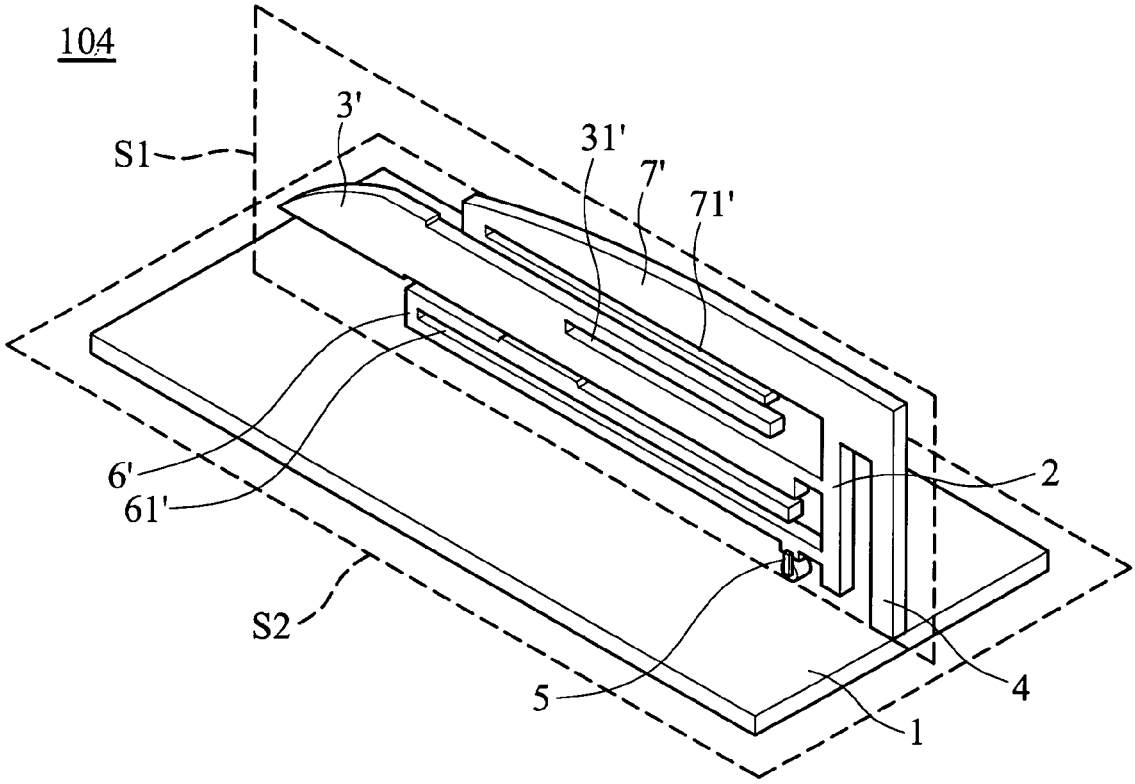
FIG. 5*b* is a perspective view of the antenna of a fourth embodiment of the invention.

FIG. 5*b* is a perspective view of the antenna 104, wherein the receiving element 3', the bandwidth modifying element 6', the matching element 7', the conductive element 2 and the short element 4 are disposed on a first plane S1. The ground element 1 is disposed on a second plane S2. The first plane Si is perpendicular to the second plane S2. Thus, improved signal reception is achieved.

The invention receives television signals in different frequencies to provide different television channels.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. An antenna, comprising:

a signal line;

a conductive element, coupled to the signal line;

a receiving element, connected to the conductive element;

a ground element;

a short element, coupled to the ground element and the conductive element; and a bandwidth modifying element, connected to the conductive element and located between the receiving element and the ground element, wherein the antenna receives a plurality of wireless signals, the wireless signals comprise a center signal with a center frequency, and the center signal comprises a center wavelength λ.

2. The antenna as claimed in claim 1, wherein the receiving element and the bandwidth modifying element extend in a first direction.

3. The antenna as claimed in claim 2, wherein a first gap is formed between the receiving element and the bandwidth modifying element.

4. The antenna as claimed in claim 3, wherein the first gap is between 0.01λ and 0.025λ.

5. The antenna as claimed in claim 4, wherein the the first gap is about 0.018λ.

6. The antenna as claimed in claim 1, wherein the bandwidth modifying element extends parallel to the ground element.

7. The antenna as claimed in claim 6, wherein a second gap is formed between the bandwidth modifying element and the ground element.

8. The antenna as claimed in claim 7, wherein the second gap is between 0.01λ and 0.025λ.

9. The antenna as claimed in claim 8, wherein the second gap is about 0.018λ.

10. The antenna as claimed in claim 1, wherein the receiving element and the bandwidth modifying element extend in a first direction, and the conductive element extends in a second direction perpendicular to the first direction.

11. The antenna as claimed in claim 1, wherein the receiving element is a metal sheet.

12. The antenna as claimed in claim 11, wherein a first opening is formed on a surface of the receiving element, and the first opening extends to another surface of the receiving element opposite thereto.

13. The antenna as claimed in claim 12, wherein the first opening is longitudinal.

14. The antenna as claimed in claim 12, wherein a second opening is formed on an edge of the receiving element, the second opening extends to another edge of the receiving element opposite thereto, and the second opening is connected to the first opening.

15. The antenna as claimed in claim 14, wherein the second opening is longitudinal.

16. The antenna as claimed in claim 1, wherein the bandwidth modifying element is a metal sheet.

17. The antenna as claimed in claim 16, wherein a third opening is formed on a surface of the bandwidth modifying element, and the third opening extends to another surface of the bandwidth modifying element opposite thereto.

18. The antenna as claimed in claim 17, wherein the third opening is longitudinal.

19. The antenna as claimed in claim 17, wherein a fourth opening is formed on an edge of the bandwidth modifying element, the fourth opening extends to another edge of the bandwidth modifying element opposite thereto, and the fourth opening is connected to the third opening.

20. The antenna as claimed in claim 19, wherein the fourth opening is longitudinal.

21. The antenna as claimed in claim 1, further comprising a matching element, connected to the conductive element, wherein the receiving element is disposed between the bandwidth modifying element and the matching element.

22. The antenna as claimed in claim 21, wherein the matching element is a metal sheet.

23. The antenna as claimed in claim 21, wherein a fifth opening is formed on a surface of the matching element, and the fifth opening extends to another surface of the matching element opposite thereto.

24. The antenna as claimed in claim 23, wherein the fifth opening is longitudinal.

25. The antenna as claimed in claim 23, wherein a sixth opening is formed on an edge of the matching element, the sixth opening extends to another edge of the matching element opposite thereto, and the sixth opening is connected to the fifth opening.

26. The antenna as claimed in claim 25, wherein the sixth opening is longitudinal.

27. The antenna as claimed in claim 1, wherein the conductive element, the receiving element and the bandwidth modifying element are disposed on a first plane, and the ground element is disposed on a second plane perpendicular to the first plane.

* * * * *